United States Patent [19]

Leary

[11] 4,285,535

[45] Aug. 25, 1981

[54] PORTABLE AUXILIARY DOOR LOCK

[76] Inventor: John E. Leary, Box 35, Woodville Herbert Rd., Bray, County Wicklow, Ireland

[21] Appl. No.: 38,458

[22] Filed: May 14, 1979

[51] Int. Cl.[3] ..... E05C 19/18

[52] U.S. Cl. ..... 292/293; 292/258

[58] Field of Search ..... 292/288–298, 292/267, 256.71, 258, 276

[56] References Cited

U.S. PATENT DOCUMENTS

| | | | |
|---|---|---|---|
| 587,496 | 8/1897 | Stone | 292/293 |
| 605,809 | 6/1898 | Plimpton | 292/293 |
| 633,078 | 9/1899 | Crane et al. | 292/292 |
| 1,544,480 | 6/1925 | Racine | 292/293 |
| 2,969,253 | 1/1961 | Schettl | 292/294 |
| 3,416,333 | 12/1968 | Weingart | 70/14 |
| 3,423,968 | 1/1969 | Foote | 70/14 |
| 3,429,151 | 2/1969 | Weingart | 70/14 |
| 3,451,235 | 6/1969 | Weingart | 70/14 |
| 3,475,929 | 11/1969 | Weingart | 70/14 |
| 3,596,961 | 8/1971 | Lippman | 292/292 |

FOREIGN PATENT DOCUMENTS

| | | | |
|---|---|---|---|
| 1248251 | 8/1967 | Fed. Rep. of Germany | 297/362 |
| 575877 | 8/1924 | France | 292/293 |

*Primary Examiner*—William E. Lyddane

*Attorney, Agent, or Firm*—Christensen, O'Connor, Johnson & Kindness

[57] ABSTRACT

A portable auxiliary locking device for securing an inwardly opening door of a room or building against unauthorized entry is disclosed. The locking device includes a threaded rod which terminates in an axially extending plate region having a hook-like flange formed at the distal end thereof. The threaded rod passes coaxially through a central opening within a tubular body member having an end face that is configured for abutment with the inner surface of the door. A locking barrel, rotatably interconnected with the second end of the body member, includes a quick-release latch that is spring-loaded into engagement with the threaded rod. In operation, the door is closed with the hook-like flange extending into the opening within the strike plate of the door frame and the threaded rod extending inwardly into the room that is to be secured. The quick-release latch is then depressed and the body member slid into abutment with the surface of the door. The locking barrel is then rotated to clamp the door in the closed position.

7 Claims, 4 Drawing Figures

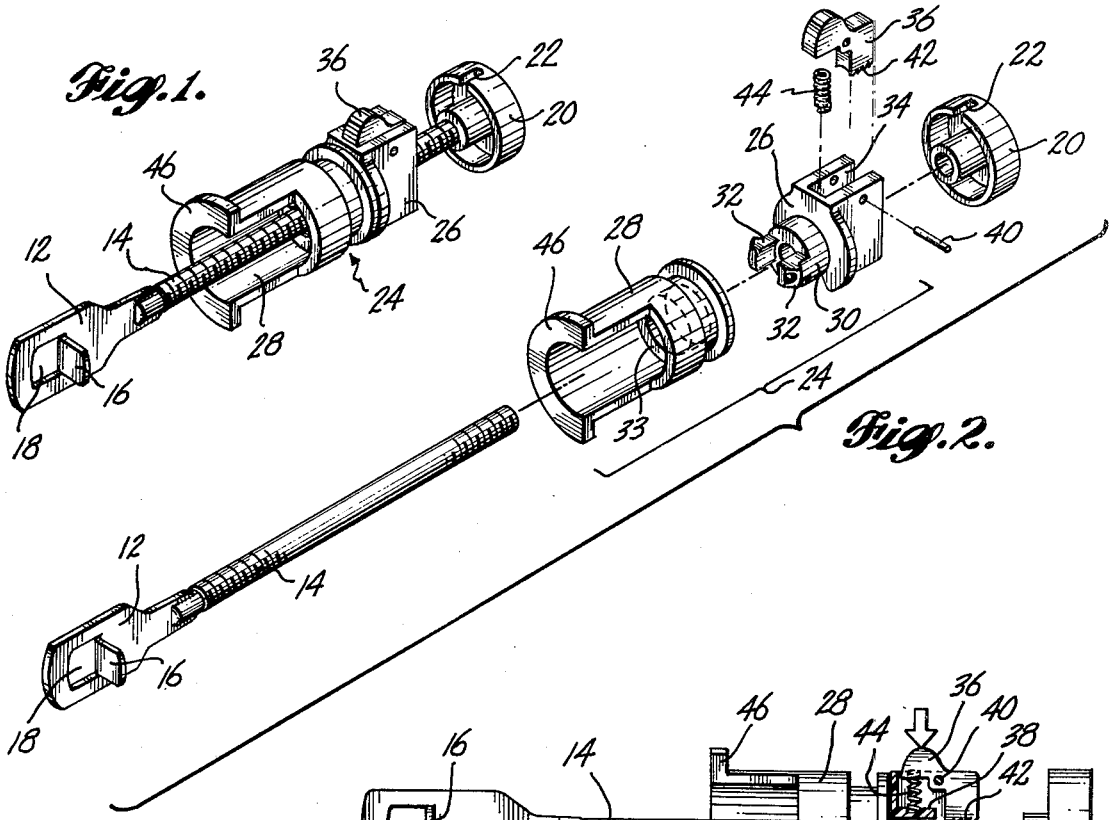
Fig. 1.
Fig. 2.
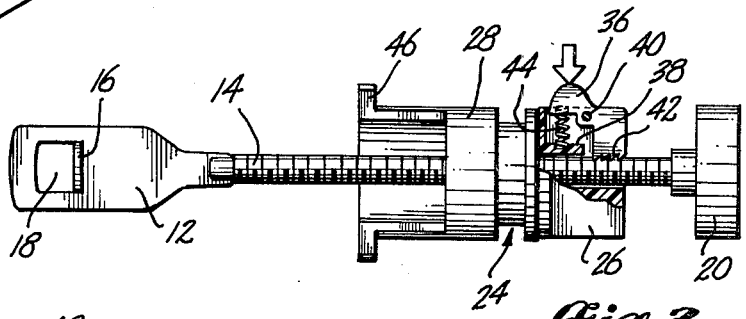
Fig. 3.
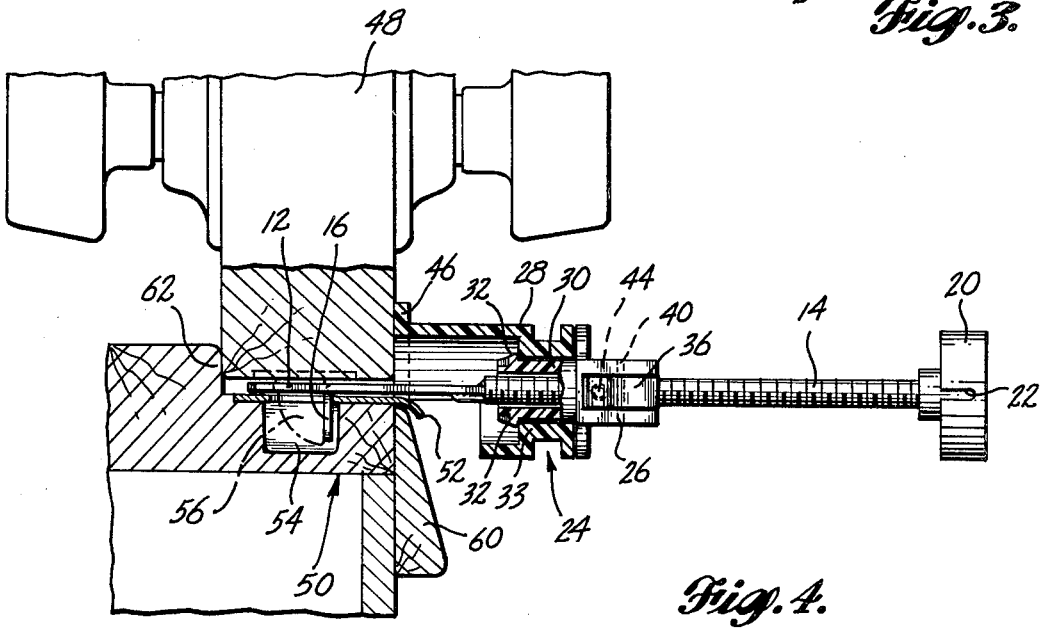
Fig. 4.

PORTABLE AUXILIARY DOOR LOCK

BACKGROUND OF THE INVENTION

This invention relates to portable door securing devices that can be temporarily installed to the inside of an inwardly swinging entrance door for preventing unauthorized entry into a room or building. More particularly, this invention relates to improved portable door locks of the type wherein the lock is installed to extend between a door and the associated frame with a first portion of the lock being engaged with the opening within a conventional frame-mounted strike plate and a second portion of the lock being moved into abutment with and secured against the surface of the door.

The need for and desirability of portable door locks that can be used by the occupants of a building or room for securing the entrance thereof against unauthorized entry has long been recognized. Such locks are, for example, especially advantageous as a supplemental lock for temporary quarters such as a hotel or motel room since the occupants of such premises have no control over access to the keys for operating the conventionally provided locking devices. Further, although various permanently mounted auxiliary locks are sometimes provided, such devices do not necessarily provide the desired degree of protection and are not always maintained in proper operating condition.

A variety of supplemental locking devices that are easily stored and/or carried in a suitcase, purse or other container have been proposed in the prior art. With respect to the present invention, such prior art devices include auxiliary locking arrangements in which a hook-like extension in the end portion of a relatively thin locking bar is inserted in the strike plate opening of the door frame with the locking bar extending between the door and door frame and a blocking member is moved along the locking bar and secured in abutment with the inner surface of the door. Examples of devices which fall into this general classification, and because of similarity in function and use provide background for the present invention, are disclosed in U.S. Pat. Nos. 633,078; 3,416,333; 3,423,968; 3,429,151; 3,451,235; 3,475,929; and 3,596,961.

Although the locking devices disclosed in the above-referenced patents operate satisfactorily in some respects and under some conditions, presently available devices present several disadvantages and drawbacks. In this regard, the shortcomings of such prior art devices primarily result because of compromises that have heretofore been necessary in attempting to satisfy several somewhat conflicting design considerations. More specifically, a portable locking device of the type addressed by the present invention should be relatively simple and economical yet provide a high degree of security and reliability. Further, such a device should not only be configured for ease of installation and operation but should be arranged for rapid removal to permit authorized entry and allow an occupant of a locked room to quickly disengage the device and evacuate the room or building in case of fire or other emergency. Additionally, a locking device of this type must not mar or otherwise damage a door and should be configured and arranged for use with entrance doors having variously configured trim or decorative molding.

The auxiliary locks disclosed in the previously referenced U.S. patents do not appear to simultaneously satisfy or fully meet the above-mentioned design goals.

For example, with the exception of U.S. Pat. No. 3,596,961, each of these references disclose locking devices in which the component that abuts the inner surface of the door extends directly outward across the adjacent door frame without accommodation for molding or trim that often surrounds the periphery of conventional entrance doors. Further, of the above-cited patents, only U.S. Pat. No. 3,596,961 and U.S. Pat. No. 633,078 disclose locking arrangements that do not require an additional device such as a padlock or integrally contained key-operated lock for maintaining the disclosed device in the fully-engaged and locked condition. Although devices employing key-operated and auxiliary locks have application to additional situations wherein a room, showcase, cabinet or other enclosure is to be locked from the outside, this feature is a distinct disadvantage when the device is used to temporarily secure the door of an occupied room or building. In particular, it is not only possible to at least temporarily misplace the necessary key, but the additional operation required to disengage the device makes it cumbersome to admit welcome or authorized persons and can make it difficult to quickly open the door should an emergency evacuation be necessary.

In addition, the prior art has not generally obtained the desired degree of security in that such devices are not arranged to withstand forces that can be exerted by a determined intruder. For example, in many of the prior art devices the component that is intended to abut the inner surface of the door must be secured in one of several predetermined positions. Oftentimes the available positions do not secure the door tightly against the frame and, when force is exerted on the outside of the door, bending moments or other concentrated forces are coupled to the locking device thereby causing the device to fail. In this regard, although previously referenced U.S. Pat. No. 3,429,151 discloses an arrangement in which the member that abuts the inner surface of the door can be tightened beyond a position in which such member is simply in contacting juxtaposition therewith, only very limited tightening or clamping action can be attained. More specifically, in the device disclosed by U.S. Pat. No. 3,429,151, the component that engages the strike plate is a flat elongated locking bar having teeth or serrations in the oppositely disposed longitudinal edges which are engaged by threads within a nut-like locking member. To provide ease of operation, the nut-like locking member includes two oppositely disposed radially extending slots that extend through the root region of the threads and permit the locking member to be slid axially along the locking bar. With this arrangement the nut-like member is rotated 90° after being urged into abutment with the door and limited tightening or clamping action is affected. The amount of tightening that is provided does not, however, exert substantial compressive force on the door and this device is further subject to the various previously-described disadvantages.

Accordingly, it is an object of this invention to provide a portable auxiliary door lock which can be used by the occupant of a room or building to securely fasten an inwardly swinging frame-mounted entrance door in a closed position; such door lock being of the type in which the a first portion of the lock engages with a strike plate or other stationary portion of the door frame and a second portion of the lock is positionable against the interior surface of the door.

It is an associated object of this invention to provide a supplemental door lock of the above-mentioned type wherein the lock is configured and arranged to permit the exertion of compressive force between the door and the adjoining region of the frame to thereby tightly clamp the door in a locked position and attain a high degree of security.

It is another object of this invention to provide a portable auxiliary door lock which is relatively simple in structure and economical to manufacture.

It is yet another object of this invention to provide a supplemental door lock that is easily operated and configured for rapid installation and removal.

Still further it is an object of this invention to provide a portable door lock that is usable with conventional inwardly swinging doors which include a variety of frame-mounted trim or decorative moldings.

SUMMARY OF THE INVENTION

These and other objects are achieved in accordance with this invention by a portable door lock which comprises a threaded rod having a relatively thin, flat plate extending axially from one end thereof. A hook-like flange extends from the terminal portion of the flat plate for engagement with the opening in the strike plate or other stationary portion of the door frame with the plate and rod being positioned to pass between the door edge and adjacent frame and project inwardly into the area to be secured. In accordance with the invention, the door is clamped in a closed position by a body assembly which coaxially surrounds the threaded rod and is operable for axial sliding movement and for rotation wherein the body assembly is threadably engaged with the rod. In the preferred embodiment the body assembly includes a tubular body member having a segmental crosssectional geometry along the first end region and a locking barrel that is rotatably coupled to the second end thereof. The threaded rod passes freely through an opening in the tubular body member and the locking barrel and a spring-loaded quick-release latch that is mounted within an axially extending slot of the locking barrel includes a concave face that is machined for engagement with the threaded rod.

To install the lock, the quick-release latch is depressed and the body assembly is slid away from the hook-like terminal region of the threaded rod. With the hook-like flange inserted in the strike plate and the door swung into the closed position, the quick-release latch is depressed so that the segmental end face of the tubular body member is in abutment with the door. The quick-release latch is then allowed to return to its normal position and the locking barrel is rotated to securely tighten the body assembly against the interior surface of the door and, in effect, clamp the door in the closed position.

Because of the segmental geometry of the portion of the body member that abuts the door, trim or molding that is mounted to the door frame does not interfere with the operation of the device. Further, since the body member does not rotate as the locking barrel is turned, substantial clamping or compressive force can be effected between the door frame and door without marring or otherwise damaging the surface of the door. In addition, the selectively operable quick-release latch not only provides convenience and ease of operation, but permits rapid removal of the door lock by simply rotating the locking barrel to relieve the exerted compressive force, depressing the quick-release latch and sliding the body member along the threaded rod and away from the surface of the door.

BRIEF DESCRIPTION OF THE DRAWING

Other objects and advantages of the present invention will be apparent to one skilled in the art after reading the following description taken together with the accompanying drawing in which:

FIG. 1 is an isometric view of a portable auxiliary door lock configured in accordance with this invention;

FIG. 2 is an exploded view of the door lock depicted in FIG. 1;

FIG. 3 is a elevation view of the locking device of FIG. 1 that is partially cut away to illustrate construction of the quick-release latch; and FIG. 4 is a partially sectional plan view which illustrates the door lock of this invention installed to a conventional hinged door.

DETAILED DESCRIPTION

With reference to FIGS. 1 through 4, the portable locking device of this invention includes a relatively thin plate 12 integrably formed in or joined to one end of a threaded rod 14. The distal portion of the plate 12 includes an angularly extending hook-like flange 16 that is dimensioned to engage the opening within a strike plate in the manner depicted in FIG. 4 and described in more detail hereinafter. As is illustrated in FIGS. 1 through 3, the flange 16 usually extends orthogonally from the major portion of the plate 12 and can be formed by machining a U-shaped slot in the plate 12 and bending the resulting tabular region outwardly so that flange 16 is adjacent an opening 18. Alternatively, in some embodiments of the invention the entire end portion of plate 12 can be bent or otherwise formed to provide the flange 16. In either case, both the plate 12 and threaded rod 14 are preferably formed from a metal capable of withstanding substantial axially directed tensional forces.

A knob-like tubular end cap 20 is pressed or otherwise retained on the opposite end of the rod 14. As shall be recognized upon understanding the manner in which the invention operates, the knob 20 is not utilized for rotating the threaded rod 14 but serves as a means for grasping and holding the locking device during installation and removal and provides a protective cover that minimizes the possibility of damage or injury that might otherwise occur if a person or object inadvertently contacts the end of rod 14 while the lock is in use. If desired, a small axially extending slot 22 or other aperture can be included in the side wall of end cap 20 so that the locking device can be hung on a small nail or other conventional fastener during periods of nonuse.

As is further illustrated in FIGS. 1 through 4, a body assembly (generally denoted by the numeral 24) coaxially surrounds the threaded rod 14. As is shown most clearly by the exploded view of FIG. 2 and by the sectional view of FIG. 4, body assembly 24 basically comprises a locking barrel 26 that is rotatably coupled to a tubular body member 28. More specifically, the locking barrel 26 includes a forwardly projecting cylindrical region 30 which passes freely through a suitably sized opening in one end of the body member 28. Two circumferentially spaced apart locking tabs 32, formed in the terminal portion of the cylindrical region 30, extend outwardly across an annular shoulder 33 that is formed within the interior bore of the body member 28 to thereby link the locking barrel 26 and body member 28 to one another while allowing rotation of locking barrel 26 relative to the threaded rod 14 and body member 28.

With particular reference to FIGS. 2 and 3, the aft region of locking barrel 26 is substantially rectangular in geometry and includes an axially extending recess or groove 34 that is configured for receiving a quick-release latch 36. As is shown in FIG. 3, the portion of the recess 34 that is nearestmost the cylindrical region 30 extends partially through the locking barrel 26 to form a lower wall section 38 whereas the portion of the recess 34 that is adjacent the rear face of locking barrel 26 extends into the central opening thereof. A pin 40 that passes transversely through suitably sized openings within locking barrel 26 and quick-release latch 36 pivotably interconnects the quick-release latch 36 to the locking barrel 26 so that a series of serrations or teeth 42 within a downwardly extending portion of quick-release latch 36 can be swung into and out of engagement with the threads which encompass threaded rod 14. A compression spring 44, positioned between the locking barrel lower wall section 38 and a forwardly extending spaced apart portion of quick-release latch 36 firmly biases the teeth 42 in engagement with threaded rod 14. As is indicated by the double arrow of FIG. 3, a contoured region of quick-release latch 36 that extends radially upward from a position directly above the compression spring 44 can be depressed to thereby disengage the teeth 42 from the threaded rod 14 and permit the body assembly 24 to be freely slid along the length of the threaded rod. Preferably, the teeth 42 are machined such that quick-release latch 36 need not be actuated in order to slide body assembly 24 toward plate 12. In such an embodiment of the invention quick-release latch 36 is, in effect, a pawl that prevents movement of body assembly 24 toward end cap 20 unless spring 44 is compressed in the previously-mentioned manner.

To permit use of the locking device of this invention with doors having variously contoured frame-mounted trim or molding, the forward portion of tubular body member 28 is molded or otherwise formed to provide an axially extending clearance region. More specifically, in the depicted embodiment, the transverse cross-sectional geometry along the forward region of tubular body member 28 substantially corresponds to an annular segment that is defined by approximately one-half of a cylinder. Further, to maximize contact region between body member 28 and the surface of the door being secured, the forward terminal region of body member 28 includes a radially extending annular flange 46.

Installation and removal of the invention can be understood in view of the above description and with particular reference to FIG. 4 which depicts the invention fully-engaged with a typical frame-mounted inwardly swinging door 48. First, to engage the locking device with the door frame 50 of door 48, the quick-release latch 36 is depressed and the body assembly 24 is slid rearwardly toward end cap 20. With the door 48 partially opened, the hook-like flange 16 of plate region 12 is inserted through the latch opening of the frame-mounted strike plate 52 such that the flange 16 extends inwardly into a latch pocket or recess 54 which receives the conventional door latch or bolt 56. The door 48 is then swung into the closed position with the door latch 56 passing through opening 18 of plate region 12 to enter latch pocket 54. With the door 48 fully closed, body assembly 24 is slid forwardly so that annular flange 46 of body member 28 abuts the inner surface of door 48. As can be noted in FIG. 4, the above-described geometry of the forward portion of body member 28 provides sufficient clearance for the inner portion of the depicted strike plate 52 and a decorative molding 60 which surrounds the periphery of door frame 50. To securely clamp or force the door 48 into a tightly closed positioned, locking barrel 26 is then rotated in the direction which urges body member 28 against door 48. Since the hook-like flange 16 abuts the edge of the opening within strike plate 52, this tightening action forces door 48 against the doorjamb region 62 which abuts the outer periphery of the fully closed door 48.

Removal of the locking device is effected by performing the steps of the above-described installation sequence in reverse order. In particular, the locking device can be rapidly removed simply by rotating locking barrel 26 until a compressive force is no longer exerted on the door 48. When the compressive force has been relieved, the quick-release latch 36 can be depressed and the body assembly 24 slid toward end cap 20. The door 48 can then be swung open in the normal manner.

It will be recognized by those skilled in the art that various modifications may be made in the embodiments herein discussed without departing from the scope and spirit of this invention. For example, although various components such as body member 28, locking barrel 26 and end cap 20 have been generally described as having regions of circular and rectangular cross-sectional geometry, other suitable geometries can be employed. Further, various modifications can easily be made in the manner in which locking barrel 26 is rotatably interconnected with the body member 28.

The embodiments of the invention in which an exclusive property or privilege is claimed are defined as follows:

1. A portable auxiliary locking device for securing an inwardly swinging door that is mounted in a frame, said locking device comprising:

a threaded rod having a relatively thin plate region extending axially from one end thereof, said plate region including an angularly extending hook-like flange configured and arranged for engagement with a portion of said door frame; and a body assembly coaxially received on said threaded rod and positionable therealong, said body assembly having a first face region configured for abutting solely with the inner surface of said door without abutting said frame when said hook-like flange is engaged with said frame and said door is in a closed position, said body assembly including a locking barrel and a body member each having a central bore for slidably receiving said threaded rod, said locking barrel including a recess having at least a portion thereof extending inwardly into said central bore, said first end face region of said body assembly being formed at a first end of said body member, said locking barrel being rotatably linked with the second end of said body member to permit rotation of said locking barrel relative to said threaded rod while said body member is stationary with respect to rotation about said threaded rod said body assembly further including quick-release means having a latch member mounted within said recess of said body member for maintaining said body assembly in threaded engagement with said threaded rod and allowing axial movement of said body assembly relative to said threaded rod through rotation of said locking barrel, said latch member having a plurality of teeth dimensioned and arranged for threaded engagement with said threaded rod, said teeth being the sole means for engaging said body assembly to said threaded rod, said quick-release means further including spring means for biasing said locking means in a position in which said teeth are threadedly engaged with said threaded rod, said locking means being manually depressible to operate said spring for disengaging said teeth from said threaded rod.

2. The portable auxiliary locking device of claim 1 wherein said first face region of said body assembly exhibits a segmental cross-sectional geometry to define an axially extending recess along the forward portion of said body assembly for clearing molding attached to said door frame.

3. The portable auxiliary locking device of claim 2 wherein said first face region of said body assembly includes an annular flange extending outwardly from the forward end of said body assembly.

4. A locking device for maintaining an inwardly swinging, frame-mounted door in a closed position, said locking device comprising:

a threaded rod having a relatively thin plate extending axially from the first end thereof, the terminal region of said plate including a flange member extending angularly outward from the surface thereof;

a tubular body member having a central opening extending axially therethrough, said tubular body member including a first end portion having a transverse cross-sectional geometry that substantially corresponds to a predetermined segment of the transverse cross-sectional geometry of the remaining portion of said tubular body member, said transverse cross-sectional geometry being dimensioned for abutment with the surface of said door without contacting surrounding portions of said frame;

a locking barrel having an axially extending central opening for freely receiving said threaded rod, said locking barrel including a first end region passing into said central opening of said tubular member and rotatably retained therein, said locking barrel further including an aperture extending transversely into said central opening thereof; and a quick-release mechanism for selectively placing said locking barrel in threaded engagement with said threaded rod and selectively disengaging said locking barrel from threaded engagement with said threaded rod to permit said locking barrel and said tubular body member to be slid axially along said threaded rod, said quick-release mechanism including an actuator having a first portion extending downwardly into said aperture of said locking barrel and a second portion extending at least to the surface of said aperture, said first portion of said actuator including tooth-like serrations dimensioned and arranged for threaded engagement with said threaded rod, said tooth-like serrations being the sole provision for threaded engagement of said locking barrel with said threaded rod, said quick-release mechanism further including a spring, said spring being mounted in structural communication with said actuator to bias said actuator in a position in which said serrations engage said threaded rod, said second portion of said actuator being depressible to operate said spring and move said serrations out ofengagement with said threaded rod.

5. The locking device of claim 4 wherein said flange member is formed from a U-shaped tabular region machined in the terminal region of said plate and bent outwardly therefrom to define an opening in said plate between said flange member and the termination of said plate.

6. The locking device of claim 5 further comprising a flange region extending radially outwardly at said first end portion of said tubular body member.

7. The locking device of claim 6 further comprising an end cap mounted and attached to the second end of said threaded rod.

* * * * *